United States Patent [19]

Dolle

[11] 4,028,706

[45] June 7, 1977

[54] SECURITY LOCK FOR TRUNK MOUNTED ANTENNA

[76] Inventor: Alvin J. Dolle, 13322 Syracuse, San Antonio, Tex. 78249

[22] Filed: Apr. 19, 1976

[21] Appl. No.: 678,449

[52] U.S. Cl. ..... 343/715
[51] Int. Cl.[2] ..... H01Q 1/32
[58] Field of Search ..... 343/713, 715, 720, 900

[56] References Cited

UNITED STATES PATENTS 3,056,570 10/1962 Slavin ..... 343/715

*Primary Examiner*—Eli Lieberman
*Attorney, Agent, or Firm*—Willard J. Hodges, Jr.

[57] ABSTRACT

A lock and mounting brace consisting of a main body with securing clips at the base and antenna latching means at the top portion. An antenna plastic or rubber grommet, a serrated locking lug, and an antenna locking arm securing the locking lug in position and firmly engaging the main body forming an integral structure.

6 Claims, 9 Drawing Figures

SECURITY LOCK FOR TRUNK MOUNTED ANTENNA

BACKGROUND OF THE INVENTION

1. Field of the Invention

The invention is associated with automobile trunk mounted radio antenna. The device is particularly designed to be used in association with a clip mounted antenna which is secured to the trunk lid of an automobile. The invention locks and secures the antenna and its base to the trunk lid. A secondary function is stabilizing and reinforcing of the antenna mounting means.

2. Description of Prior Art

This invention is closely associated with radio antenna of the type disclosed in U.S. Pat. to Bacow, No. 3,369,247; and Gronlund, U.S. Pat. No. 3,555,551. In recent years automobile radios and, in particular, CBs, have become exceedingly popular. The installation of a second radio in automobiles is ordinarily accomplished by mounting an auxiliary, whip-type antenna on the bumper, roof or trunk lid of the vehicle. The device of this invention is designed to be utilized in conjunction with a trunk lid type antenna mount which clips into the edge of the trunk lid.

SUMMARY OF THE INVENTION

The device of this invention is primarily designed to be constructed of injection mold plastic components. A wide variety of molding techniques are acceptable as well as various plastic materials. Your inventor visualized the preferred construction would utilize injection molding techniques with a plastic known as "Lexan" available through General Electric, 1 Plastics Avenue, Pittsfield, Massachusetts 01201. The device of this invention constitutes a lock and mounting base reinforcing and securing in position a trunk mounted antenna. The preferred embodiment of the invention consists of a main body including trunk lid clips grasping the edge of the trunk lid. The other components of the invention comprise plastic or rubber antenna grommet fitting around the mounting threads of the antenna, the locking lug fitting over the flexible grommet which are secured into position by screwing th antenna threading connector into the antenna base. The locking lug is securely attached in position by an antenna locking arm which engages the main body securing the composite structure to the trunk lid. The invention is shown and described in three species in this application.

For a detailed description of the construction of the various components of the various species of the invention, reference is made to the attached drawings wherein identical reference characters will be used to refer to identical or equivalent components throughout the various views and the detailed description.

DESCRIPTION OF THE PREFERRED EMBODIMENT

Figure 2:
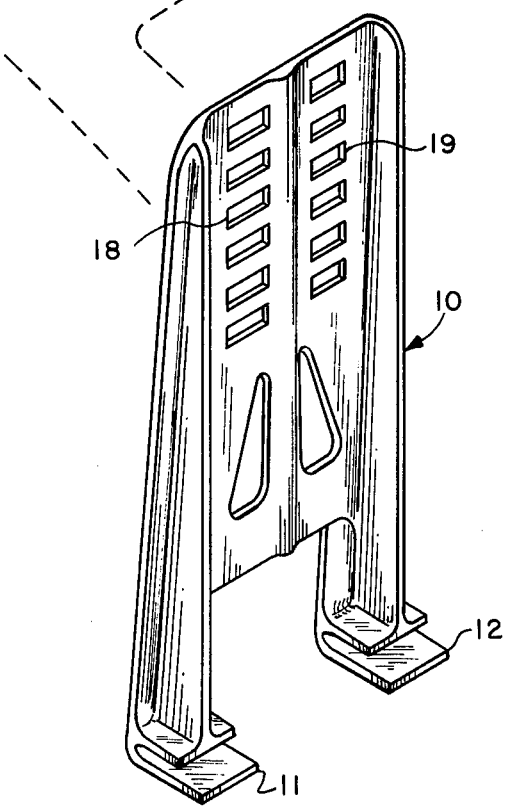
FIG. 2 is a perspective view of the main body of the preferred embodiment.
Figure 3:
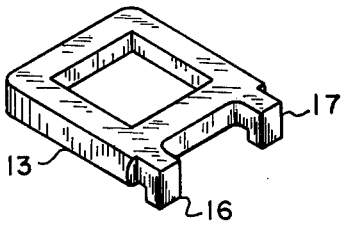
FIG. 3 is a perspective view of the locking arm of the preferred embodiment employing locking hooks compatible with the species of FIG. 1 and FIG. 2.
Figure 4:
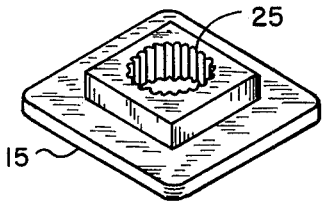
FIG. 4 is a perspective view of the locking lug employed in all species of the invention.
Figure 5:
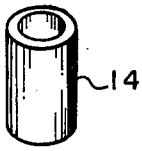
FIG. 5 is a perspective view of the rubber or plastic grommet employed in all species of the device.

For a detailed description of the preferred embodiment, reference is made to the attached drawings. The prototype of the initial preferred embodiment was constructed by carving the configuration desired in a block of plaster of paris. The initial prototype was produced by making a casting generally of the configuration of FIG. 2 by pouring the plastic into the carved mold and permitting it to solidify. Such a method of casting did, in fact, produce a satisfactory working prototype. The preferred embodiment, however, is visualized to employ a precision mold having a general configuration of the structure of FIGS. 1 and 2, which would be molded by injection from a rigid plastic for precision and desired strength. The first species of the invention is the device illustrated in FIGS. 1–5. The device consists of main body 10 having a first trunk lid clip 11 and a second trunk lid clip 12. The species of the invention of FIG. 2 employed a locking arm 13 as generally illustrated in FIG. 3. In conjunction with locking arm 13 is employed a rubber or flexible plastic antenna grommet 14 of FIG. 5 over which is placed locking lug 15 of FIG. 4. In this species of the invention, locking arm 13 is constructed with a first locking arm hook 16 and a second locking arm hook 17. This locking arm 13 is made compatible with main body 10 of FIG. 2 by constructing in the main body a series of first arm hook apertures 18 and second arm hook apertures 19. This series of apertures 18 and 19 permits variation of the height of the antenna locking arm 13 to be compatible with various configurations of antenna bases 20 and antenna insulators 21. The whip-like antenna 22 with which the device of this invention is visualized to be employed normally consists of the antenna 22 which is secured to an antenna spring 23 below which is an antenna threaded connector 24. The assembly of the device of this invention visualizes that antenna grommet 14 of FIG. 5 placed over the antenna threaded connector 24, after which locking lug 15 is placed over the grommet 14. The antenna threaded connector 24 is screwed into the threaded connector to antenna insulator 21 secured to the antenna base 20. The secure connection of antenna 22 to the antenna base 20 is accomplished by securely screwing the antenna threaded connector 24 firmly into the antenna insulator or base 21 and 20. This connection comprises the antenna grommet 14 inside the locking lug serrated aperture 25 of FIG. 4. After this is accomplished the antenna locking arm 13 of FIG. 3 is placed over locking lug 15 and the antenna locking arm hooks of FIG. 3 are placed in engagement with compatible first and second arm hook apertures 18 and 19 in the main body 10 in the manner generally illustrated in FIG. 1. This completes the installation of the species of the invention illustrated in FIGS. 1–5.

Figure 1:
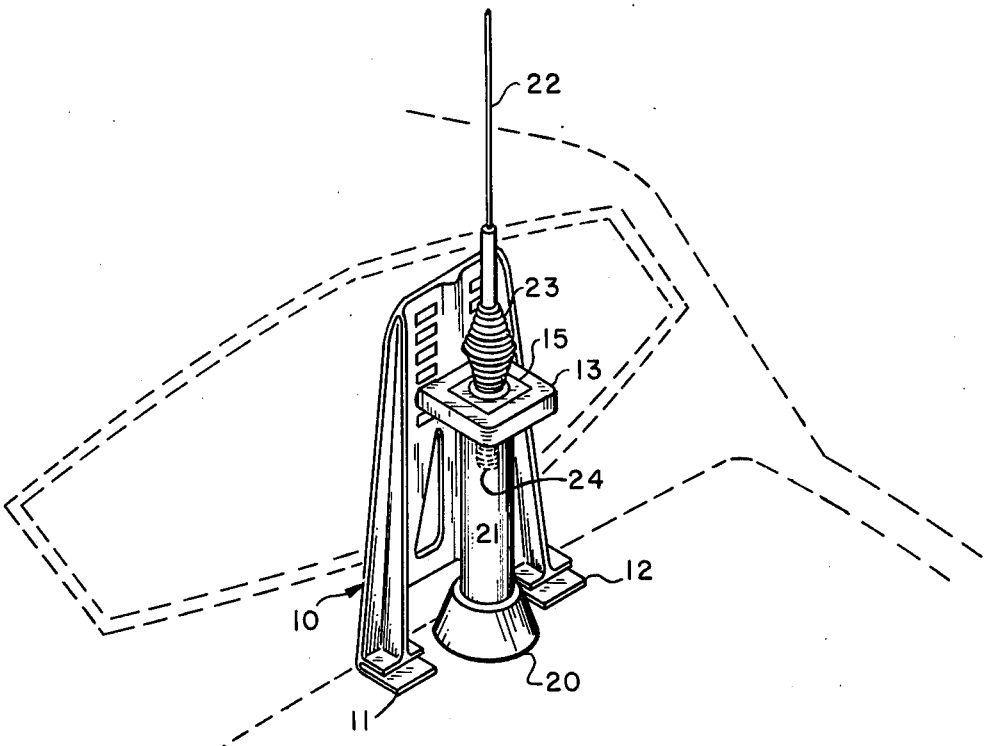
FIG. 1 is a composite view of the security lock complete with a CB antenna schematically mounted on automobile trunk lid.
Figure 6:
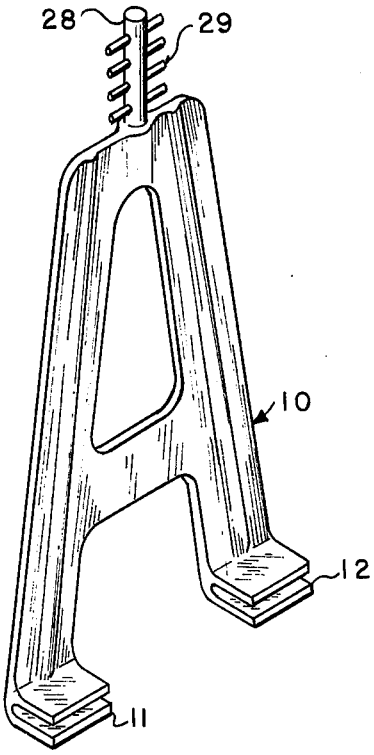
FIG. 6 is a perspective view of the species of the device employing locking pins for engaging a locking arm.
Figure 7:
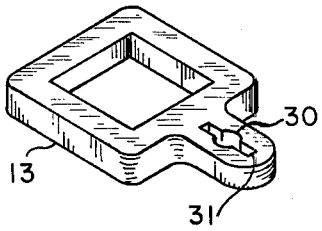
FIG. 7 is a perspective view of a slotted, locking arm compatible with the species of the invention of FIG. 6.

For an illustration of the two other species of the invention, reference is made to FIGS. 6–9. In all species of the invention plastic casting techniques are employed. The species of the invention of FIGS. 6 and 7 employ a main body 10 having first trunk lid clip 11, second trunk lid clip 12. The variation of the structure is included at the upper extremities of the main body 10 and consists of an antenna arm shaft 28 from which projects a series of arm shaft locking pins 29. The preferable arrangement of the various components are substantially as illustrated in FIG. 6. The antenna locking arm 13 of this species of the invention is illustrated in FIG. 2. The general configuration and dimensions of the locking arm 13 of the invention of FIG. 7 are compatible with locking lug 15 of FIG. 4 and the plastic or rubber grommet 14 of FIG. 5. The variations in the structure of the species of FIG. 7 employs the shaft aperture 30 and locking pin slots 31 compatible with the dimensions of antenna arm shaft 28 and antenna arm shaft locking pins 29. Antenna locking arm 13 of FIG. 7 in assembly is placed over antenna arm shaft 28 and the locking pin slots 31 passed over the antenna arm shaft locking pins 29 to the desired height at which time a rotation of the antenna locking arm 13 90° secures the device in position at the desired height on antenna arm shaft 28 of the main body 10. This species of the device is finally assembled into position as schematically illustrated in FIG. 1 utilizing all the previous described components and their arrangements with the exception of utilizing a main body 10 of FIG. 6 and the antenna locking arm of FIG. 7.

Figure 9:
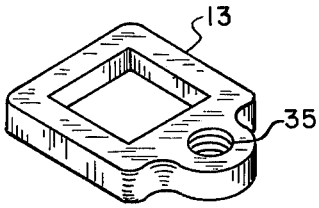
FIG. 9 is a perspective view of a threaded, locking arm compatible with the species of the main body illustrated in FIG. 8.
Figure 8:
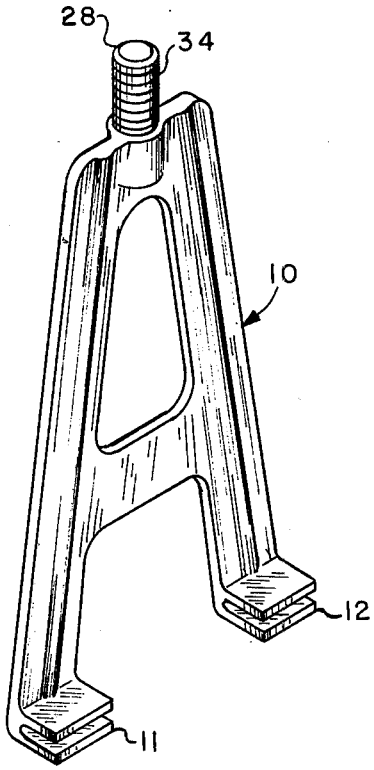
FIG. 8 is a perspective view of the main body of the species of the device employing threaded securing means for engaging a locking arm.

Another species of the device is illustrated in FIGS. 8 and 9. A main body 10 of plastic employing first and second trunk lid clips 11 and 12 are utilized and an antenna arm shaft 28 is employed in this species of the invention. The variation consisting of construction of antenna arm shaft threads 34 on the shaft 28 of FIG. 8. Compatible with this species of the device, the antenna locking arm 13 of FIG. 9 is constructed with antenna arm threads 35 in the shaft aperture 30. The method of securing the main body 10 of FIG. 8 to the antenna locking arm 13 is conventional thread screw connection wherein locking arm 13 is rotated and screwed down onto antenna arm shaft 28 of FIG. 8 to the desired height. Again employing the plastic or rubber grommet of FIG. 5 in conjunction with the locking lug 15 of FIG. 4, the antenna 22 and insulator 21 and the antenna base 20 are engaged in a compatible structure as illustrated in FIG. 1, the only variation being in the employment of the main body 10 and the antenna locking arm 13 of FIGS. 8 and 9.

OPERATION OF THE DEVICE

In recent months, a combination of factors has resulted in numerous thefts of CB radios and antenna components. The devices of this invention are designed to make the thefts of CB antennas 22, antenna bases 20 and insulators 21 more difficult. Plastic components of this invention do not interfere with radio signal reception. They result in a more stabilized securing of the antenna base 20 to the vehicle trunk lid. The appearance and configuration of the composite structure as illustrated in FIG. 1 is quite pleasant in appearance. In addition to the stated purpose of the invention as indicated in the title, locking the various CB antenna components in position, a more stable mounting of the composite components is accomplished.

Having shown and described the invention in detail including the detail of the description of the three species of the invention, what is desired to be claimed is all the variations and equivalents of the device not departing from the scope of the invention as defined in the appended claims.

I claim:

1. A lock and mounting brace for a trunk mounted automobile antenna comprising:

a. a main body having a top portion and a bottom portion, b. a multiplicity of trunk lid clips constructed in the bottom portion of said main body, c. an antenna locking arm securing means constructed in the top portion of said main body, d. an antenna locking arm adapted to securely engage said antenna locking arm securing means, and e. an antenna locking lug engaged by said antenna locking arm, said antenna locking arm so constructed and arranged as to fit over and engage a radio antenna means.

2. The invention of claim 1 wherein the locking arm securing means comprises:

a. an aperture constructed in the top portion of said main body, and b. an arm hook constructed on said antenna locking arm in such a configuration as to securely engage said aperture in the top portion of said main body.

3. The invention of claim 1 wherein the locking arm securing means comprises:

a. an antenna arm shaft constructed in the top portion of said main body, and b. an antenna arm shaft locking pin and projecting from said antenna arm shaft, said antenna arm securely engaging said antenna arm locking pin.

4. The invention of claim 3 wherein the said locking arm comprises:

a. a shaft aperture of a diameter adequate to receive said antenna arm shaft, and b. a locking pin slot capable of passing over said locking pin and securely engaging said antenna arm shaft upon rotation.

5. The invention of claim 1 wherein the locking arm securing means comprises:

a. an antenna arm shaft threads formed in the surface of said antenna arm shaft, b. a shaft aperture constructed in said antenna locking arm, and c. antenna arm threads constructed internal of said shaft aperture for engaging said antenna arm shaft threads.

6. The invention of claim 1 comprising:

a. locking lug serrated aperture constructed in said locking lug, said serrated aperture passing over and securely engaging, b. an antenna grommet.

* * * * *